US010146164B2

(12) United States Patent
Yoshimoto

(10) Patent No.: US 10,146,164 B2
(45) Date of Patent: Dec. 4, 2018

(54) IMAGE FORMING APPARATUS

(71) Applicant: CANON KABUSHIKI KAISHA, Tokyo (JP)

(72) Inventor: Tetsuhiro Yoshimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/907,469

(22) Filed: Feb. 28, 2018

(65) Prior Publication Data

US 2018/0188677 A1 Jul. 5, 2018

Related U.S. Application Data

(63) Continuation of application No. PCT/JP2016/071858, filed on Jul. 26, 2016.

(30) Foreign Application Priority Data

Sep. 8, 2015 (JP) ..... 2015-176964

(51) Int. Cl.
*G03G 15/00* (2006.01)
*G03G 15/20* (2006.01)
(Continued)

(52) U.S. Cl.
CPC ..... *G03G 15/55* (2013.01); *G03G 15/20* (2013.01); *G03G 15/5004* (2013.01);
(Continued)

(58) Field of Classification Search
CPC ..... G03G 15/20; G03G 15/5004; G03G 15/5016; G03G 15/55; G03G 21/10;
(Continued)

(56) References Cited

U.S. PATENT DOCUMENTS

2011/0274450 A1* 11/2011 Atarashi ..... G03G 15/205 399/37
2012/0044530 A1* 2/2012 Kato ..... B41J 3/44 358/1.15
(Continued)

FOREIGN PATENT DOCUMENTS

JP 2005-122130 A 5/2005
JP 2011-237480 A 11/2011
(Continued)

OTHER PUBLICATIONS

International Search Report and Written Opinion issued in International Patent Application No. PCT/JP2016/071858.

*Primary Examiner* — Hoang Ngo
(74) *Attorney, Agent, or Firm* — Fitzpatrick, Cella, Harper & Scinto

(57) ABSTRACT

It is determined whether a performing condition for first welding detection is satisfied. If the performing condition for the first welding detection is satisfied, the first welding detection is performed. On the other hand, if the performing condition for the first welding detection is not satisfied, the first welding detection is skipped. The performing condition for the first welding detection is that second welding detection has detected welding of a relay. The first welding detection is performed before image formation is performed. The second welding detection is performed after image formation has ended.

12 Claims, 7 Drawing Sheets

(51) Int. Cl.

| | |
|---|---|
| ***G03G 21/00*** | (2006.01) |
| ***G03G 21/14*** | (2006.01) |
| ***G03G 21/16*** | (2006.01) |
| ***H01H 47/00*** | (2006.01) |

(52) U.S. Cl.
CPC ..... *G03G 15/5016* (2013.01); *G03G 21/00* (2013.01); *G03G 21/14* (2013.01); *G03G 21/16* (2013.01); *G03G 21/1633* (2013.01); *H01H 47/00* (2013.01)

(58) Field of Classification Search
CPC .... G03G 21/14; G03G 21/16; G03G 21/1633; H01H 47/00
See application file for complete search history.

(56) References Cited

U.S. PATENT DOCUMENTS

| | | | |
|---|---|---|---|
| 2014/0293360 | A1 | 10/2014 | Inukai |
| 2015/0241500 | A1 | 8/2015 | Mochizuki et al. |

FOREIGN PATENT DOCUMENTS

| | | | |
|---|---|---|---|
| JP | 2012-042573 | A | 3/2012 |
| JP | 2014-057454 | A | 3/2014 |
| JP | 2014-193017 | A | 10/2014 |

* cited by examiner

IMAGE FORMING APPARATUS

This application is a continuation of International Patent Application No. PCT/JP2016/071858 filed on Jul. 26, 2016, and claims priority to Japanese Patent Application No. 2015-176964 filed on Sep. 8, 2015, the entire content of both of which is incorporated herein by reference.

TECHNICAL FIELD

The present invention relates to an image forming apparatus.

BACKGROUND ART

Image forming apparatuses of an electrophotographic type use a thermal fixing method that fixes a toner image by heating the toner image with a heater. In view of power saving, a hot line and a neutral line that supply power to the heater are provided with their respective relays. As relay contacts are welded due to aging, it is necessary to detect whether they are welded in view of protection of the heater. In PTL 1, relay welding detection is performed both when image formation is started and when image formation has ended.

CITATION LIST

Patent Literature

PTL 1: Japanese Patent Laid-Open No. 2012-042573

SUMMARY OF INVENTION

Technical Problem

However, an image forming apparatus that performs welding detection when image formation is started cannot turn ON the heater until the welding detection is completed. As the image forming apparatus cannot perform image formation until the temperature of the heater reaches a target temperature, the welding detection increases the user's wait period. In view of this, the present invention provides an image forming apparatus with which a wait period associated with relay welding detection can be shortened compared to conventional cases.

Solution to Problem

The present invention provides, for example, an image forming apparatus including: a first line that is one of a neutral line and a hot line that supply, to a load, power supplied from an alternating-current power source; a second line that is the other of the neutral line and the hot line; a first relay, arranged on the first line, that turns ON/OFF a supplying of the power to the load; a second relay, arranged on the second line, that turns ON/OFF a supplying of the power to the load; a monitor configured to monitor a power supply state at a position in a stage subsequent to the first relay on the first line; a controller configured to control ON/OFF of each of the first relay and the second relay; a welding detector configured to perform first welding detection that detects whether the first relay is welded in accordance with a power supply state monitored by the monitor when a first performing condition is satisfied, and performing second welding detection that detects whether the first relay is welded in accordance with a power supply state monitored by the monitor when a second performing condition is satisfied; and a storage configured to store a result of the second welding detection. The first performing condition is that the result of the second welding detection stored in the storage indicates that the first relay is welded. The welding detector performs the first welding detection when the result of the second welding detection indicates that the first relay is welded, and skips the first welding detection when the result of the second welding detection does not indicate that the first relay is welded. The controller performs control to turn ON the second relay and turn OFF the first relay while the welding detector is performing the first welding detection or the second welding detection. The controller further performs control to turn ON each of the first relay and the second relay when an image forming job is to be started.

Further features of the present invention will become apparent from the following description of exemplary embodiments (with reference to the attached drawings).

BRIEF DESCRIPTION OF DRAWINGS

The accompanying drawings, which are incorporated in and constitute a part of the specification, illustrate an embodiment of the present invention, and together with a description thereof, serve to explain the principles of the present invention.

DESCRIPTION OF EMBODIMENTS

[Configuration of Image Forming Apparatus]

Figure 1:
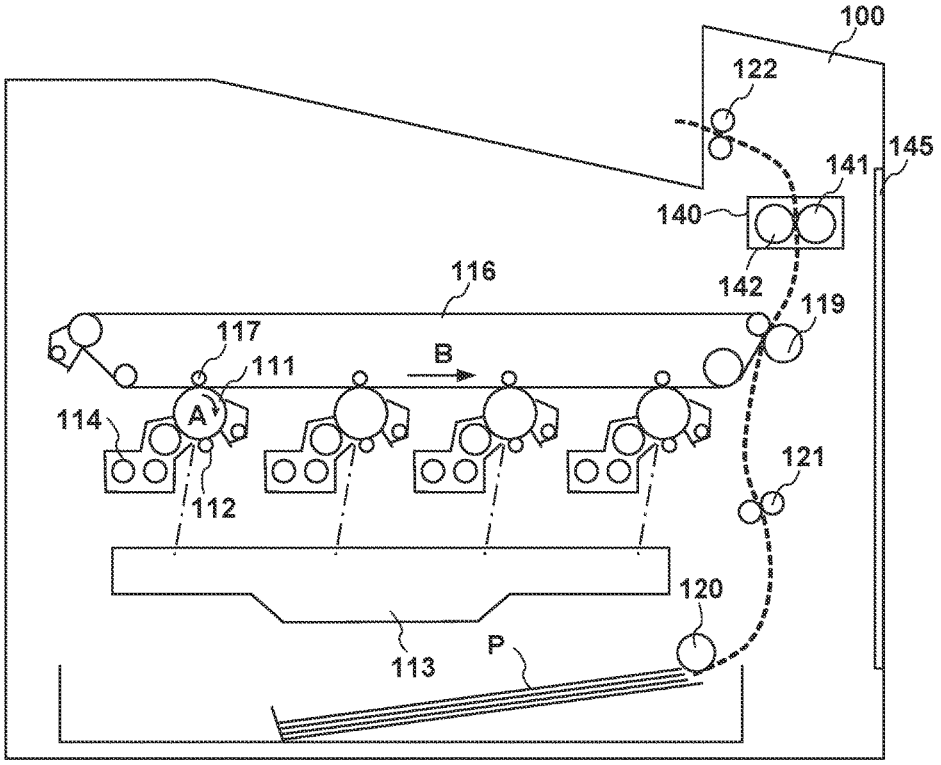
FIG. 1 is a cross-sectional diagram showing an image forming apparatus.

A schematic configuration of an image forming apparatus 100 will be described using FIG. 1. Although the image forming apparatus 100 may be an image forming apparatus that forms a single-color image, it will herein be assumed as an image forming apparatus that forms a multicolor image. The image forming apparatus 100 may be any of a printing apparatus, a printer, a copier, a multifunction peripheral, and a facsimile machine. The image forming apparatus 100 includes four stations that form toner images using yellow, magenta, cyan, and black developers (toner). Although reference numerals are given only to the constituents of the yellow station in FIG. 1, all of the four stations can be configured in the same manner. Note that each station functions as an image former for forming a toner image on image carriers, such as a photosensitive drum 111 and an intermediate transfer belt 116, using toner.

The photosensitive drum 111 is a cylindrical image carrier or photosensitive member on which an electrostatic latent image and a toner image are carried. A charging apparatus 112 uniformly charges the photosensitive drum 111 that rotates in the direction of arrow A. An exposure apparatus 113 outputs laser light that has been modulated based on image information, and deflects the laser light so that the laser light scans a surface of the photosensitive drum 111. As a result, an electrostatic latent image is formed. A developing apparatus 114 forms a toner image by developing the electrostatic latent image using toner. A primary transfer roller 117 primary-transfers the toner image on the photosensitive drum 111 to the intermediate transfer belt 116. The intermediate transfer belt 116 rotates in the direction indicated by arrow B. A sheet P is supplied to a sheet conveyance path by a paper supply roller 120. The sheet P may be referred to as recording paper, a recording material, a recording medium, paper, a transfer material, transfer paper, etc. A registration roller 121 corrects skew of the sheet P, and the sheet P is conveyed to a secondary transfer section formed by the intermediate transfer belt 116 and a secondary transfer roller 119. In the secondary transfer section, the toner image conveyed by the intermediate transfer belt 116 is secondary-transferred to the sheet P. As such, the primary transfer roller 117 and the secondary transfer roller 119 function as a transfer device for transferring the toner image to the sheet. When the toner image and the sheet P pass through a nip section formed by a fixing film 142 and a pressurizing roller 141, a fixing device 140 fixes the toner image onto the sheet P by applying heat and pressure to the toner image. The fixing film 142 is provided with a heater. Thereafter, the sheet P is discharged to a paper discharge tray by a paper discharge roller 122. Note that a maintenance door 145 that is opened during the maintenance of the fixing device 140 and the like is provided on a side surface of the image forming apparatus 100.

[Control System]

Figure 2:
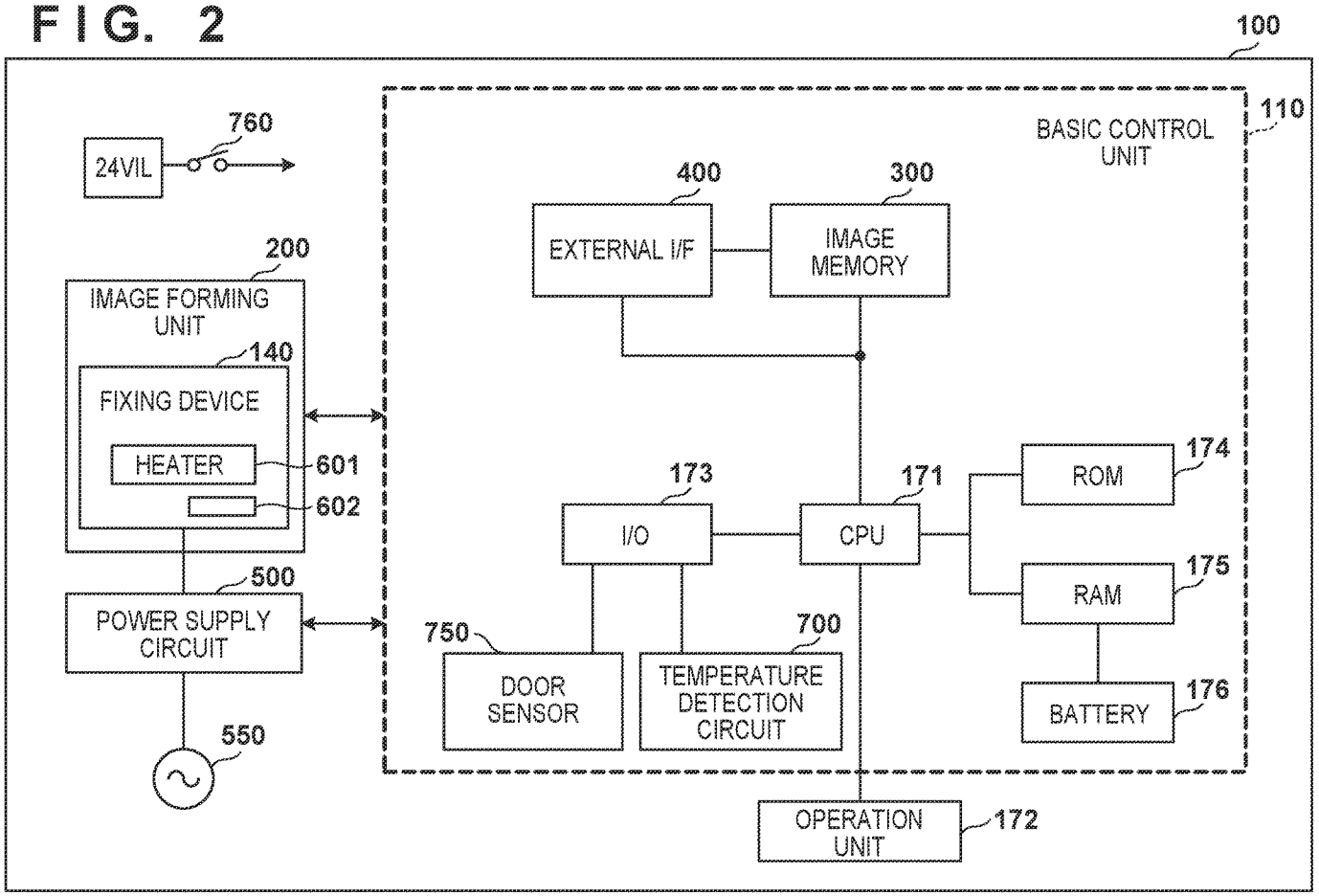
FIG. 2 is a block diagram showing a control system.

FIG. 2 is a block diagram showing a control system of the image forming apparatus 100. A basic control unit of the image forming apparatus 100 is denoted by 110. A CPU 171 controls an image forming unit 200 and the like in accordance with control programs stored in a ROM 174. A RAM 175 stores information that indicates an operational state of the image forming apparatus 100. A battery 176 is connected to the RAM 175. Therefore, the RAM 175 can hold the stored content also when power is not supplied to the image forming apparatus 100 from a commercial power source. Various types of loads that drive the image forming unit 200, such as a motor and a clutch, are connected to an I/O port 173. Furthermore, a temperature detection circuit 700 that detects the temperature of the fixing device 140, as well as a door sensor 750 that detects opening and closing of the maintenance door 145, are connected to the I/O port 173. When the state of the maintenance door 145 detected by the door sensor 750 changes from open (open door) to closed door, the CPU 171 turns ON a power source 24 VIL that generates a 24-V voltage. On the other hand, when the state of the maintenance door 145 detected by the door sensor 750 changes from closed door to open door, the CPU 171 turns OFF the power source 24 VIL that generates the 24-V voltage. This ON/OFF may be realized by controlling a door switch 760. Note that the door sensor 750 may be omitted. In this case, the door switch 760 is a mechanical switch that is turned OFF/ON in mechanical coordination with opening and closing of the maintenance door 145.

A power supply circuit 500 is connected to a heater 601 disposed inside the fixing device 140. The power supply circuit 500 supplies an alternating-current voltage from an alternating-current power source 550 to the heater 601. A detection signal from a temperature sensor 602 disposed inside the fixing device 140 is input to the temperature detection circuit 700. A voltage level of the detection signal input to the temperature detection circuit 700 is correlated with the temperature of the heater 601. That is to say, the voltage level indicates the temperature of the heater 601. When the temperature of the heater 601 exceeds a predetermined temperature, the temperature detection circuit 700 outputs a control signal representing an instruction for stopping the power supply to the power supply circuit 500. In response to the control signal, the power supply circuit 500 stops the supply of the alternating-current voltage from the alternating-current power source 550 to the heater 601. In this way, when the temperature of the heater 601 exceeds the predetermined temperature, the supply of the alternating-current voltage is stopped to protect the heater 601.

The CPU 171 is connected to an operation unit 172, and causes a display apparatus of the operation unit 172 to display a notification message, and accepts information that has been input by an operator via an input apparatus of the operation unit 172. The CPU 171 is also connected to an external I/F 400 that receives image data from an external device, such as a PC (personal computer), and to an image memory 300 that holds image data. The CPU 171 sequentially outputs line data generated by decompressing image data to the exposure apparatus 113 of the image forming unit 200.

[Power Supply Circuit]

Figure 3:
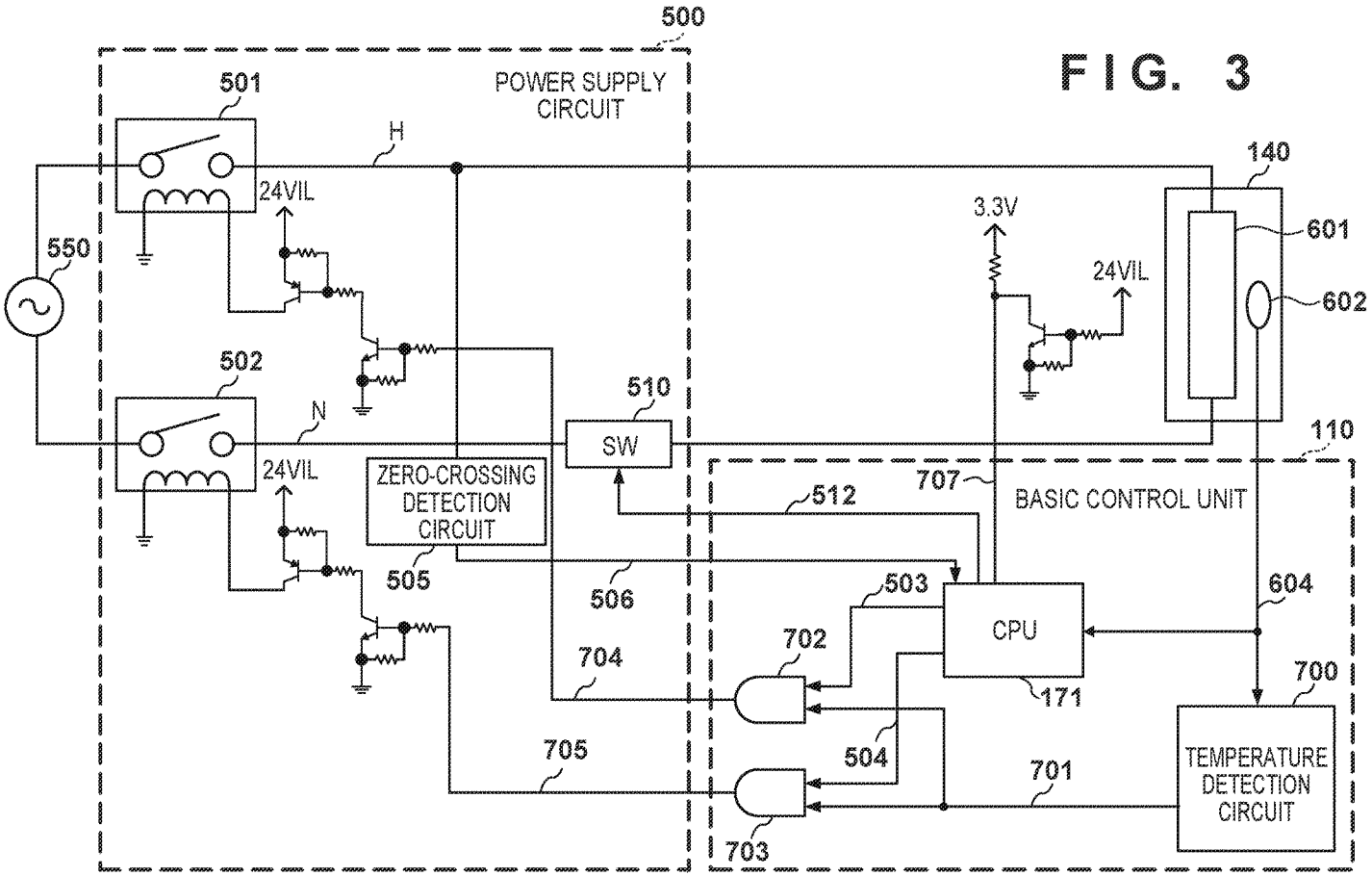
FIG. 3 is a diagram showing a power supply circuit, a basic controller, and a fixing device.

FIG. 3 shows a schematic configuration of the power supply circuit 500. The temperature sensor 602 that detects the temperature of the heater 601, such as a thermistor, is disposed inside the fixing device 140. For example, a thermistor is an element that increases or decreases in resistance as it increases in temperature. That is to say, the resistance value and the temperature are correlated with each other. A temperature detection signal 604 output from the temperature sensor 602 is input to the control unit 110 and the temperature detection circuit 700. The control unit 110 turns ON/OFF a semiconductor switch 510 so that the voltage level of the temperature detection signal 604 matches the voltage level equivalent to a target temperature. That is to say, a fixing temperature of the fixing device 140 is adjusted at the target temperature by controlling the power input to the heater 601. A control signal 512 for turning ON/OFF the semiconductor switch 510 is output from the CPU 171. The semiconductor switch 510 is, for example, a triac. The temperature detection circuit 700 is a circuit that protects the heater 601 from an excessive temperature increase of the heater 601. When the predetermined temperature higher than the target temperature of the fixing device 140 is exceeded, the temperature detection circuit 700 stops the power supply to the heater 601 by outputting a supply stop signal 701. That is to say, the temperature detection circuit 700 opens relay contacts when the voltage level of the temperature detection signal 604 exceeds the voltage level equivalent to the predetermined temperature.

A hot line H and a neutral line N for supplying the alternating-current voltage are connected from the alternating-current power source 550, which is a commercial power source, to the heater 601, which is a load. A first relay 501 is arranged on the hot line H between the alternating-current power source 550 and the heater 601. A second relay 502 is arranged on the neutral N between the alternating-current power source 550 and the heater 601. Note that the terms "first relay" and "second relay" are used merely for convenience, and these terms may be reversed. A control signal 503 output from the I/O port 173 controls ON/OFF of the first relay 501. A control signal 504 output from the I/O port 173 controls ON/OFF of the second relay 502. A zero-crossing detection circuit 505 detects a zero-crossing of the alternating-current voltage supplied from the alternating-current power source 550 in a stage subsequent to the first relay 501, and outputs a detection signal 506 corresponding to a zero-crossing timing. The CPU 171 specifies whether the alternating-current voltage exists and the phase of the alternating-current voltage based on the detection signal 506. That is to say, the CPU 171 determines whether each of the first relay 501 and the second relay 502 is welded based on whether the alternating-current voltage exists. Furthermore, the CPU 171 performs wavenumber control for adjusting an amount of power supplied to the heater 601 using the phase (zero-crossing point) of the alternating-current voltage as a reference. Note that the CPU 171 receives the detection signal 506 via the I/O port 173.

A first AND circuit 702 outputs a control signal 704 indicating a logical product of the control signal 503 output from the CPU 171 via the I/O port 173 and the supply stop signal 701 output from the temperature detection circuit 700. When the control signal 704 is at a high level, the first relay 501 is turned ON, and when this signal is at a low level, the first relay 501 is turned OFF. Note that the first relay 501 is turned OFF also when a driving voltage is not supplied from the 24 VIL power source. A second AND circuit 703 outputs a control signal 705 indicating a logical product of the control signal 504 output from the control unit 110 and the supply stop signal 701 output from the temperature detection circuit 700. When the control signal 705 is at a high level, the second relay 502 is turned ON, and when this signal is at a low level, the second relay 502 is turned OFF. Note that the second relay 502 is turned OFF also when the driving voltage is not supplied from the 24 VIL power source. Each of the control signals 503, 504 and the supply stop signal 701 indicates supply (relay-ON) at a high level and stop (relay-OFF) at a low level. That is to say, when one of the CPU 171 and the temperature detection circuit 700 issues a relay-OFF instruction, the relays are turned OFF. In a state where the temperature detection circuit 700 has not issued a relay-OFF instruction, the CPU 171 can perform control to turn ON one of the first relay 501 and the second relay 502, and turn OFF the other. This control is used in welding detection (welding test).

As described above, the first relay 501 and the second relay 502 are connected to the 24 VIL power source, which is turned OFF/ON in coordination with opening and closing of the maintenance door 145. That is to say, when the maintenance door 145 is open, the supply of the driving voltage from the 24 VIL power source is stopped, and thus the first relay 501 and the second relay 502 are turned OFF.

In the present embodiment, two mechanisms are provided for protecting the heater 601. The CPU 171 switches OFF all of the semiconductor switch 510, the first relay 501, and the second relay 502 when the temperature detected by the temperature sensor 602 exceeds a threshold Tmax1. Accordingly, the power supply to the heater 601 is stopped when the temperature of the heater 601 is excessive. Meanwhile, the temperature detection circuit 700 outputs the supply stop signal 701 when the temperature detected by the temperature sensor 602 exceeds a threshold Tmax2 larger than the threshold Tmax1. Accordingly, the temperature detection circuit 700 can issue an instruction for stopping the power supply to the heater 601 even if the CPU 171 was not able to issue an instruction for stopping the power supply to the heater 601. In this way, the mechanism for protecting the heater 601 may two-fold.

[Flowchart]

Relay welding detection according to the present embodiment will be described using FIG. 4. In step S401, the CPU 171 determines whether any of performing conditions for first welding detection is satisfied. One of the performing conditions is, for example, that the CPU 171 has been activated due to the power supply from a commercial power source to the image forming apparatus 100. One of the performing conditions is that there has been an instruction for performing an image forming job via the operation unit 172 or a host computer. One of the performing conditions is that the image forming apparatus 100 has returned from sleep (power saving mode). Note that even when these conditions related to a performance timing are satisfied, the first welding detection is skipped if a prerequisite condition is not satisfied. Note that the prerequisite condition is that welding of the first relay 501 has already been detected by second welding detection. Therefore, in step S401, the CPU 171 determines whether welding of the first relay 501 has already been detected by the second welding detection. For example, the CPU 171 determines whether the first relay 501 has been detected as welded by reading out a welding detection result stored in the RAM 175. If welding has already been detected, the CPU 171 proceeds to step S402. In step S402, the CPU 171 performs the first welding detection. If welding of the first relay 501 has not been detected by the first welding detection, step S404 follows. If welding of the first relay 501 has been detected by the first welding detection, the CPU 171 stops or prohibits the performance of an image forming job.

If the second welding detection has discovered that the relay is not welded in step S401, the CPU 171 skips the first welding detection and proceeds to step S403. In step S403, in order to start the power supply to the heater 601, the CPU 171 switches ON each of the first relay 501 and the second relay 502. Consequently, the alternating-current voltage supplied from the alternating-current power source 550 is applied to the heater 601. In step S404, the CPU 171 starts the above-described temperature control for the heater 601. In step S405, the CPU 171 performs the image forming job. When the image forming job has ended, the CPU 171 proceeds to step S406. In step S406, the CPU 171 performs the second welding detection. Note that the content of the first welding detection and the content of the second welding detection are the same. However, the first welding detection and the second welding detection differ from each other not only in a performance timing, but also in that the first welding detection can be omitted depending on the result of the second welding detection.

The state of the power source after the end of image formation depends on the settings and the state of the image forming apparatus 100. In accordance with a sleep transition period designated via the operation unit 172, the CPU 171 manages a period in which the image forming apparatus 100 makes a transition to sleep. The sleep transition period may be, for example, selected from among a plurality of setting values, such as 10 seconds, 1 minute, 5 minutes, 10 minutes, and so on. The CPU 171 starts time counting by a timer when image formation has ended, and causes the image forming apparatus 100 to make a transition to sleep when a value of the timer reaches the sleep transition period. For example, in a case where the sleep transition period is set to 10 seconds, the image forming apparatus 100 makes a transition to sleep when 10 seconds have elapsed since the end of image formation. The CPU 171 performs the second welding detection during the 10 seconds. As stated earlier, the CPU 171 may perform the first welding detection when returning from sleep.

<Second Welding Detection>

Figure 5:
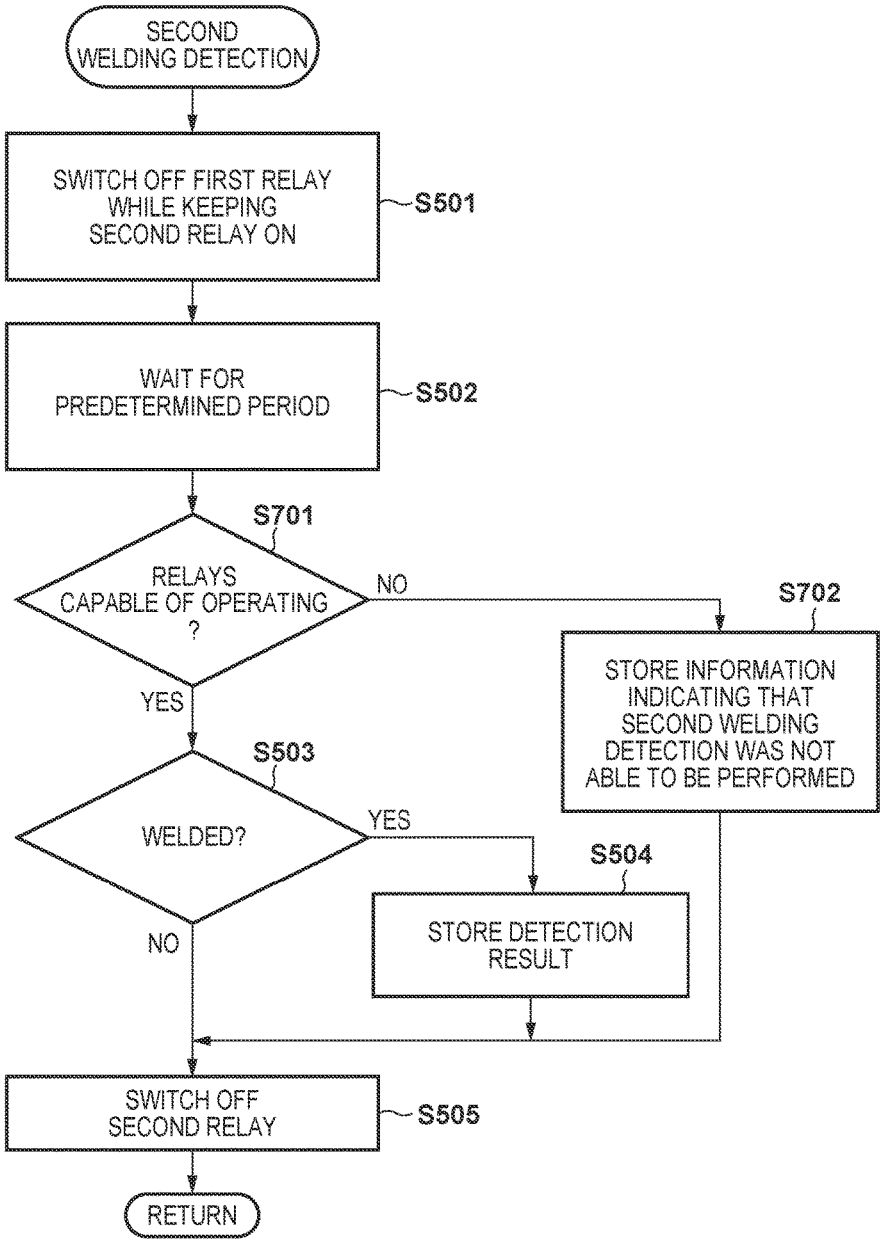
FIG. 5 is a flowchart showing second welding detection.

The second welding detection, which is performed when an image forming job has ended, will be described using FIG. 5. In FIG. 5, steps S701 and S702 are options and thus will be described later. In step S501, the CPU 171 switches OFF the first relay 501 while keeping the second relay 502 ON. That is to say, the CPU 171 switches the control signal 503 to the low level, and keeps the control signal 504 at the high level. In step S502, the CPU 171 waits for a predetermined period. The predetermined period is a period that is necessary for making a transition to a state where the relay is stably OFF (a state where chattering has ceased), and is a so-called relay make period (e.g., 100 msec). Once the CPU 171 has confirmed that the predetermined period has elapsed using a timer, a counter, and the like, it proceeds to step S503.

In step S503, the CPU 171 determines whether the first relay 501 is welded based on the detection signal 506 output from the zero-crossing detection circuit 505. For example, the CPU 171 determines whether the zero-crossing detection circuit 505 has detected a zero-crossing based on the detection signal 506 output from the zero-crossing detection circuit 505. Note that as the first relay 501 is OFF, a zero-crossing should not be detected essentially. However, if the first relay 501 is welded, a zero-crossing is detected. Therefore, if a zero-crossing is detected, the CPU 171 determines that the first relay 501 is welded and proceeds to step S504, and if a zero-crossing cannot be detected, the CPU determines that the first relay 501 is not welded and proceeds to step S505.

In step S504, the CPU 171 stores a welding detection result indicating that the first relay 501 is welded to the RAM 175. Note that also when the first relay 501 is not welded, the CPU 171 may store a welding detection result indicating that the first relay 501 is not welded to the RAM 175. Thereafter, step S505 follows. In step S505, the CPU 171 switches OFF the second relay 502 by switching the level of the control signal 504 from the high level to the low level. Consequently, the heater 601 makes a transition to the power saving mode.

<First Welding Detection>

Figure 6:
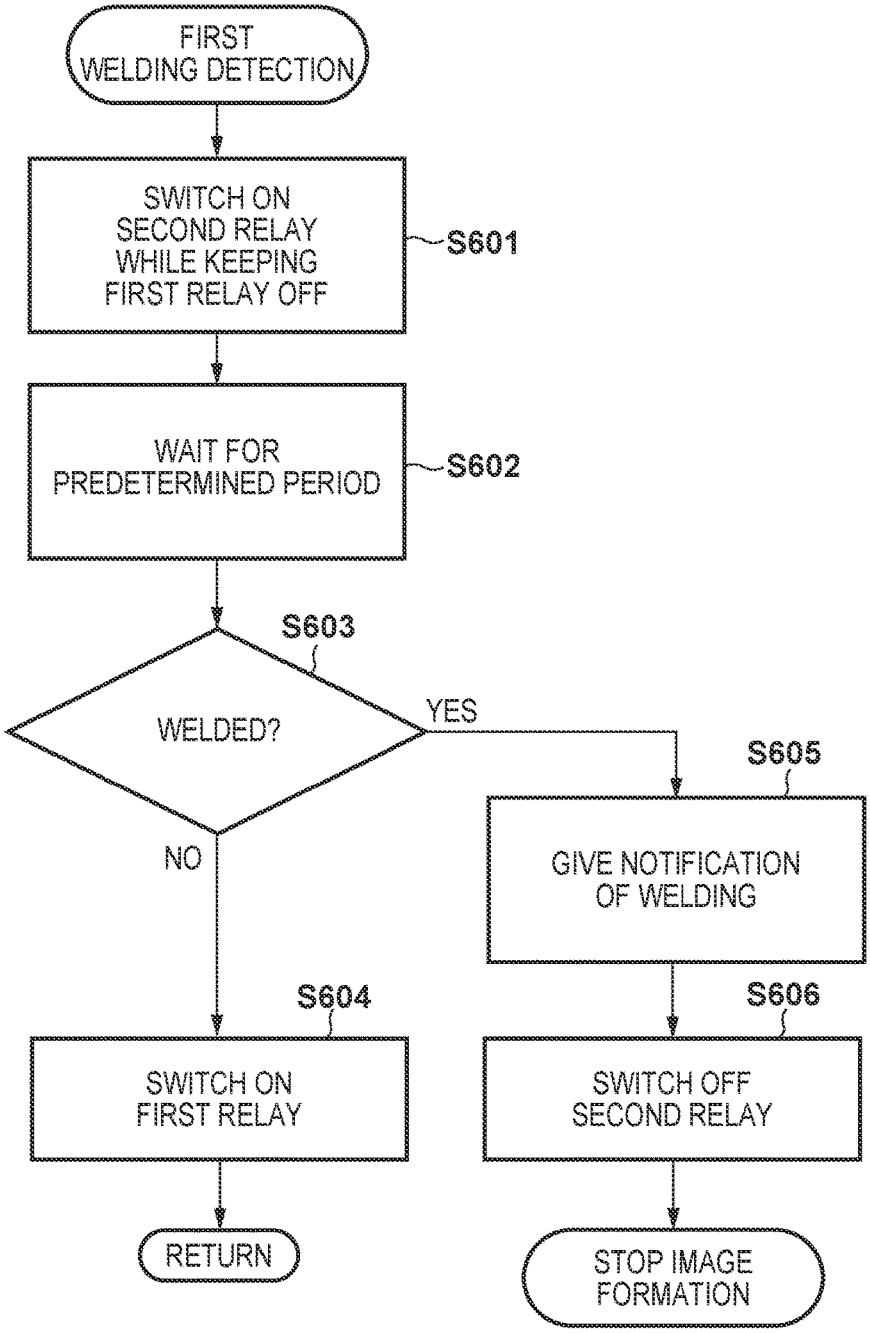
FIG. 6 is a flowchart showing first welding detection.

The first welding detection will be described using FIG. 6. In step S601, in order to perform welding detection, the CPU 171 switches ON the second relay 502 while keeping the first relay 501 OFF. In step S602, the CPU 171 waits for a predetermined period. The predetermined period is a period that is necessary for making a transition to a state where the relay is stably OFF. In step S603, the CPU 171 determines whether the first relay 501 is welded based on the detection signal 506 output from the zero-crossing detection circuit 505. If the first relay 501 is not welded, the CPU 171 proceeds to step S604 and switches ON the first relay 501. On the other hand, if the first relay 501 is welded, the CPU 171 proceeds to step S605. In step S605, the CPU 171 gives notification of welding of the relay. For example, the CPU 171 outputs a message indicating that the relay is welded, a message indicating that a repair is needed, and so on to the display apparatus of the operation unit 172. In step S606, the CPU 171 switches OFF the second relay 502.

As described above, in the present embodiment, the first welding detection is skipped if welding is not detected by the second welding detection that is performed when image formation has ended. Therefore, the present embodiment provides an image forming apparatus that performs relay welding detection capable of shortening a wait period.

Although the first welding detection and the second welding detection are performed per an image forming job in the foregoing description, configuration may be taken such that they are not performed each time an image forming job is performed. For example, the first welding detection may be performed when the image forming apparatus 100 has been activated, and the second welding detection may be performed when the image forming apparatus 100 shuts down. Furthermore, the second welding detection may be performed when the image forming apparatus 100 makes a transition to sleep, and the first welding detection may be performed when the image forming apparatus 100 returns from sleep. Note that in either case, the first welding detection is skipped if welding is not detected by the second welding detection. By thus skipping the first welding detection, the relay contacts are opened and closed a fewer number of times; this should prolong the life of the relays.

<Welding Detection in Consideration of 24 VIL Power Source>

The CPU 171 may determine whether welding detection can be performed by detecting a relay operation voltage supplied from the 24 VIL power source when image formation has ended. As described above, when the maintenance door 145 is open, the 24 VIL power source is turned OFF, both of the first relay 501 and the second relay 502 are turned OFF, and the power supply to the heater 601 is stopped. In this case, the CPU 171 cannot perform welding detection because the first relay 501 and the second relay 502 are OFF irrespective of the levels of the control signals 503, 504. In particular, in the foregoing embodiment, the CPU 171 determines that welding has not occurred on the ground that a zero-crossing was not able to be detected. Therefore, also when the power supply from the 24 VIL power source is stopped, the second relay 502 is turned OFF, and a zero-crossing is not detected. That is to say, as a zero-crossing is not detected even if the first relay 501 is welded, the CPU 171 mistakenly determines that the relay is not welded. In view of this, the CPU 171 may determine whether welding detection can be accurately performed by detecting whether power is supplied from the 24 VIL power source.

The aforementioned options in FIG. 5, namely steps S701 and S702, will be described. In step S701, the CPU 171 determines whether the first relay 501 and the second relay 502 are capable of operating based on a 24 VIL detection signal 707. For example, if the 24 VIL detection signal 707 is at a high level, the CPU 171 determines that the 24 VIL power source is supplying power. On the other hand, if the 24 VIL detection signal 707 is at a low level, the CPU 171 determines that the 24 VIL power source is not supplying power. If the first relay 501 and the second relay 502 are capable of operating due to the power supply from the 24 VIL power source, the CPU 171 proceeds to step S503 and performs welding detection. On the other hand, if the first relay 501 and the second relay 502 are not capable of operating due to no power supply from the 24 VIL power source, the CPU 171 proceeds to step S702. In step S702, the CPU 171 stores information indicating that the second welding detection was not able to be performed (the relays were not capable of operating) to the RAM 175.

Figure 4:
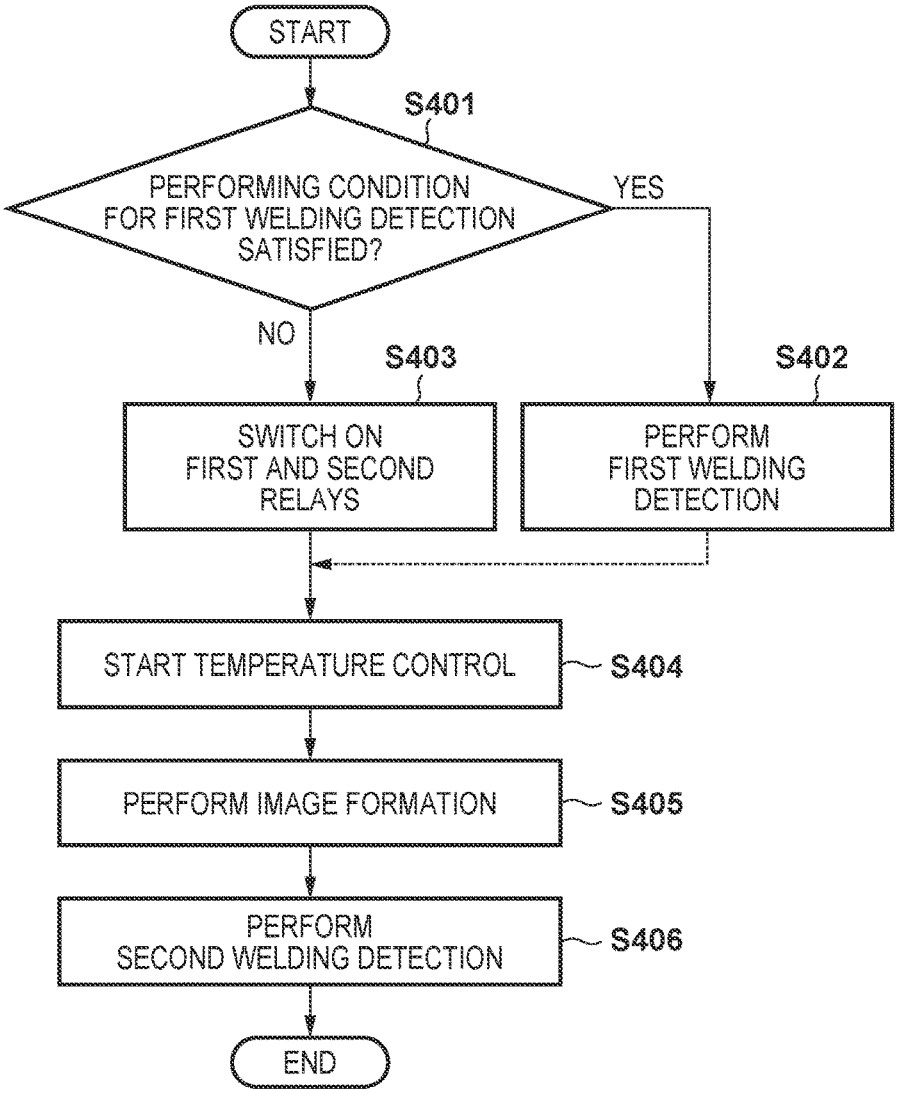
FIG. 4 is a flowchart showing image formation processing.

In a case where the 24 VIL power source is taken into consideration, in step S401 shown in FIG. 4, the CPU 171 determines whether the information indicating that the second welding detection was not able to be performed is stored in the RAM 175. That is to say, the CPU 171 determines whether the second welding detection was accurately performed. If the second welding detection was accurately performed, the CPU 171 further determines whether the second welding detection has detected welding of the first relay 501. If welding of the first relay 501 has been detected, the CPU 171 proceeds to step S402. If welding of the first relay 501 has not been detected, the CPU 171 proceeds to step S403. On the other hand, if the second welding detection was not accurately performed, the CPU 171 performs the first welding detection irrespective of the result of the second welding detection. That is to say, the CPU 171 proceeds from step S401 to step S402.

As described above, the CPU 171 may determine whether the image forming apparatus 100 was in a state where it can accurately perform the second welding detection at the performance timing of the second welding detection. This would make it possible to prevent a situation in which the first welding detection is mistakenly skipped. Consequently, whether the first relay 501 is welded can be determined more accurately. It would be also possible to prevent a situation in which image formation is performed even though the first relay 501 is welded.

Although welding detection for the first relay 501 is performed in the description of the foregoing embodiment, welding detection may be performed with respect to the second relay 502. In this case, in the foregoing description, it is sufficient to read the first relay 501 as the second relay 502, and read the second relay 502 as the first relay 501.

Furthermore, upon completion of the first welding detection for the first relay 501, the first welding detection may be subsequently performed with respect to the second relay 502. In this case, upon completion of the second welding detection for the first relay 501, the second welding detection is subsequently performed with respect to the second relay 502. Note that in order to reduce a welding detection period, upon completion of the first welding detection and the second welding detection for the first relay 501, the first welding detection and the second welding detection may be performed with respect to the second relay 502 at the next performance timing. In this way, welding detection may be performed alternately with respect to the first relay 501 and the second relay 502. As only one of the first relay 501 and the second relay 502 serves as a detection target in one welding detection, it should be possible to reduce a period necessary for one welding detection approximately by half.

<Summary>

Figure 7:
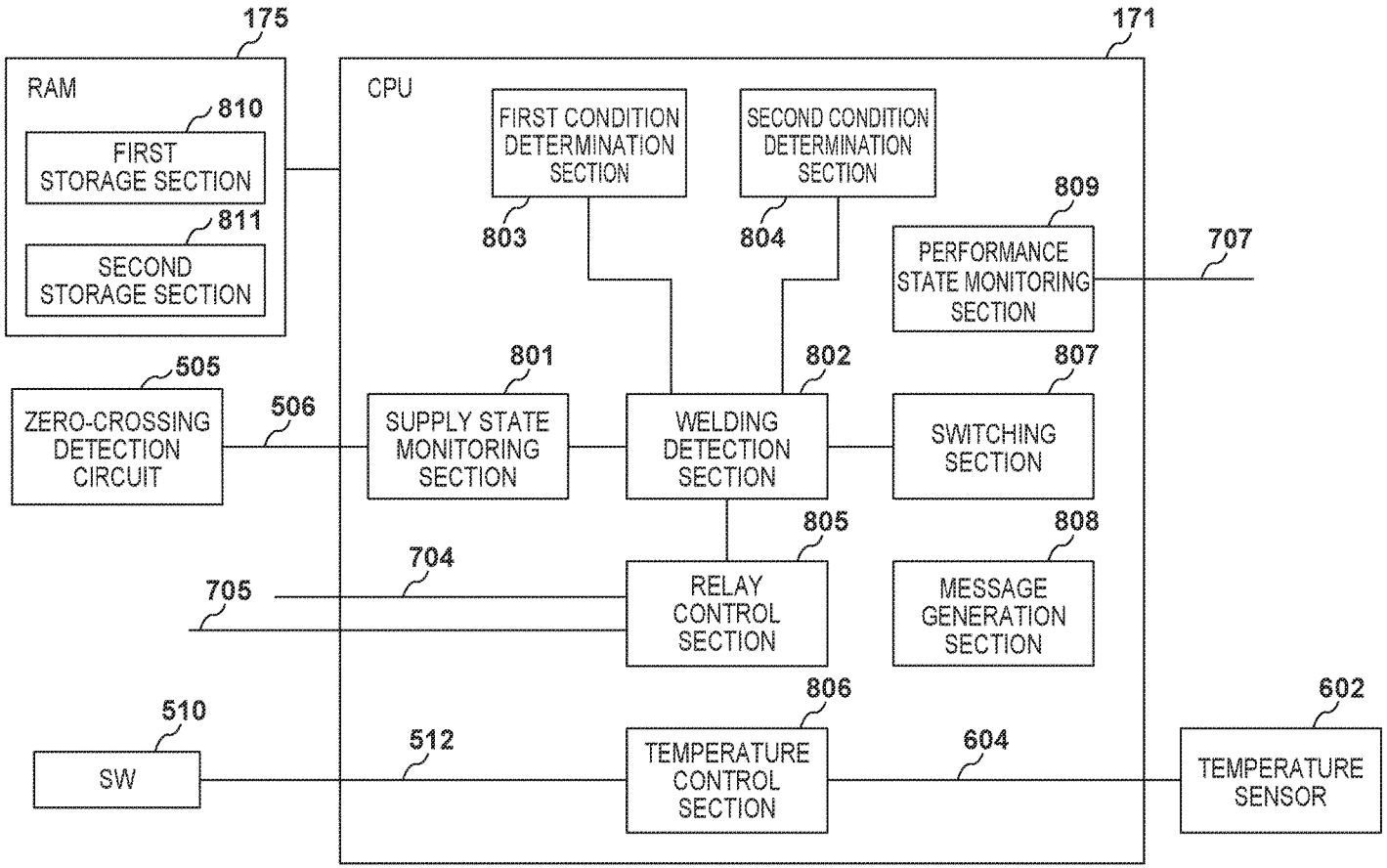
FIG. 7 is a diagram showing functions realized by a CPU.

Using FIG. 7, examples of functions that are realized by the CPU 171 performing control programs will be illustrated. Note that all or a part of these functions may be realized by a logic circuit, such as an ASIC (application-specific integrated circuit) and an FPGA (field-programmable gate array). As has been described using FIG. 3, one of the neutral line N and the hot line H that supply power supplied from the alternating-current power source 550 to the load functions as a first line. Meanwhile, the other of the neutral line N and the hot line H functions as a second line. Although it is assumed that the hot line H is the first line and the neutral line N is the second line in the description of the foregoing embodiment, their relationship may be reversed. The first relay 501 is one example of a relay that turns ON/OFF the first line. The second relay 502 is one example of a relay that turns ON/OFF the second line.

A supply state monitoring section 801 monitors a power supply state at a position in a stage subsequent to the first relay 501 on the first line. For example, the supply state monitoring section 801 outputs, to a welding detection section 802, a signal indicating that the power is supplied if the zero-crossing detection circuit 505 has detected a zero-crossing. The supply state monitoring section 801 outputs, to the welding detection section 802, a signal indicating that the power is not supplied if a zero-crossing has not been detected. In other words, the supply state monitoring section 801 does not output, to the welding detection section 802, a signal indicating that the power is supplied if a zero-crossing has not been detected. As has been described in relation to step S403, a relay control section 805 performs control to turn ON each of the first relay 501 and the second relay 502 when an image forming job has been started. As has been described in relation to steps S501 and S601, the relay control section 805 performs control to turn ON the second relay 502 and turn OFF the first relay 501 when welding detection, which detects whether the first relay 501 is welded, has been started.

A first condition determination section 803 determines whether a first performing condition for performing the first welding detection is satisfied. On the other hand, a second condition determination section 804 determines whether a second performing condition for performing the second welding detection is satisfied. For example, the first performing condition is that the result of the second welding detection stored in a first storage section 810 indicates that the first relay 501 is welded. If the result of the second welding detection indicates that the first relay 501 is welded, the welding detection section 802 performs the first welding detection. In particular, if the result of the second welding detection does not indicate that the first relay 501 is welded, the welding detection section 802 skips the first welding detection. This realizes the image forming apparatus 100 with which a wait period associated with relay welding detection can be shortened compared to conventional cases.

The first performing condition may be that an instruction for performing an image forming job has been issued to the image forming apparatus 100 and the result of the second welding detection indicates that the first relay 501 is welded. In this case, the second performing condition is that the image forming apparatus 100 has ended the image forming job. As the temperature of the heater 601 increases in an image forming job, it is necessary to switch OFF the first relay 501 and protect the heater 601 from an excessive temperature increase. Therefore, when the operation unit 172 has issued an instruction for starting an image forming job, it would be necessary to detect whether the first relay 501 is welded.

Furthermore, the first performing condition may be that the image forming apparatus 100 is activated and the result of the second welding detection indicates that the first relay 501 is welded. In this case, the second performing condition is that the image forming apparatus 100 has been instructed to stop via the operation unit 172. The image forming apparatus 100 is often activated when an operator wishes to form an image. Therefore, when the image forming apparatus 100 is activated, there is a high possibility that image formation is to be started, and it would be necessary to detect whether the first relay 501 is welded before the image formation.

The first performing condition may be that the image forming apparatus 100 has returned from the power saving mode (sleep) and the result of the second welding detection indicates that the first relay 501 is welded. In this case, the second performing condition is that the image forming apparatus 100 satisfies a condition for making a transition to the power saving mode. Upon completion of the second welding detection, the CPU 171 causes the image forming apparatus 100 to make a transition to the power saving mode. It is presumed that an operator wishes to form an image when the operator operates the operation unit 172 to make the image forming apparatus 100 return from sleep. Therefore, when the image forming apparatus 100 has returned from sleep, welding detection should be performed.

As described above, the welding detection section 802 performs the second welding detection when the image forming apparatus 100 is stopped, when an image forming job has ended, or when the image forming apparatus 100 makes a transition to the power saving mode. Furthermore, the welding detection section 802 performs the first welding detection when the image forming apparatus 100 has been activated, when the image forming apparatus 100 starts an image forming job, or when the image forming apparatus 100 has returned from the power saving mode. Note that the first welding detection is skipped when the result of the second welding detection does not indicate that the first relay 501 is welded.

The first storage section 810 of the RAM 175 functions as a storage configured to store the result of the second welding detection. The welding detection section 802 or the first condition determination section 803 may determine whether the first relay 501 is welded based on the result of the second welding detection stored in the first storage section 810. If the first relay 501 is welded, the first welding detection is performed. If the first relay 501 is not welded, the first welding detection is skipped. This realizes the image forming apparatus 100 with which a wait period associated with relay welding detection can be shortened compared to conventional cases. Note that the first storage section 810 may be a rewritable nonvolatile storage apparatus, such as an EEPROM. In this case, the battery for holding information in the RAM 175 would be unnecessary.

As has been described in relation to step S604, if the first welding detection has discovered that the first relay 501 is not welded, the relay control section 805 switches the first relay 501 from OFF to ON so as to perform an image forming job. Consequently, the heater 601 starts to increase in temperature. That is to say, once the soundness of the first relay 501 has been confirmed, power is input to the heater 601 immediately, and thus the operator's wait period should be shortened.

As has been described in relation to step S605, the display apparatus of the operation unit 172 may function as an output unit for outputting the result of the first welding detection and as a notifying unit configured to notify information. In particular, if the first welding detection has discovered that the first relay 501 is welded, the output unit outputs a message that gives notification of welding of the first relay 501. This enables an operator to understand that the first relay 501 has failed and request a maker or the like to replace the first relay 501. Note that the output unit may be a communication apparatus that transmits such a message to an administrator, a maker, and the like.

As has been described using FIG. 1, the maintenance door 145 may be provided that is opened during the maintenance of the image forming apparatus 100. When the maintenance door 145 is closed, a door switch 760 connects the 24 VIL power source, which is a relay power source, to each of the first relay 501 and the second relay 502. Furthermore, when the maintenance door 145 is opened, the door switch 760 connects the 24 VIL power source to neither the first relay 501 nor the second relay 502. In this way, when the maintenance door 145 is opened, the alternating-current voltage is not applied to the heater 601.

As has been described in relation to steps S701 and S702, if the maintenance door 145 is opened at a timing for performing the second welding detection, the first relay 501 and the second relay 502 become incapable of operating. That is to say, the welding detection section 802 cannot perform the second welding detection. Therefore, in this case, the first welding detection should be performed, irrespective of the result of the second welding detection, when the next performance timing of the first welding detection arrives. In view of this, a second storage section 811 of the RAM 175 functions as a second storage configured to store information indicating whether the second welding detection has been performed. Note that if the relay power source is connected to neither the first relay 501 nor the second relay 502 when the second welding detection is to be started, the welding detection section 802 does not perform the second welding detection, and causes the second storage section 811 to hold information indicating that the second welding detection has not been performed. Note that if the relay power source is connected to each of the first relay 501 and the second relay 502 when the second welding detection is to be started, the welding detection section 802 performs the second welding detection. Furthermore, if the second storage section 811 does not stores information indicating that the second welding detection has not been performed, the welding detection section 802 either performs or refrains from performing the first welding detection depending on the result of the second welding detection stored in the first storage section 810. If the second storage section 811 stores information indicating that the second welding detection has not been performed, the welding detection section 802 performs the first welding detection irrespective of the result of welding detection stored in the first storage section 810. This would make it possible to prevent the failure to perform the second welding detection and the first welding detection continuously.

The supply state monitoring section 801 may detect a zero-crossing of the alternating-current voltage that is applied to the load via the first line as a power supply state. The welding detection section 802 may determine that the first relay 501 is welded if the supply state monitoring section 801 detects a zero-crossing in the welding test, and determine that the first relay 501 is not welded if the supply state monitoring section 801 does not detect a zero-crossing.

The semiconductor switch 510 functions as a power switch that turns ON/OFF the second line in order to control power supplied to the heater 601, which is the load, of the fixing device. Furthermore, the temperature sensor 602 functions as a temperature detector for detecting the temperature of the heater 601. A temperature control section 806 functions as a temperature controller for controlling the semiconductor switch 510 so that the temperature detected by the temperature sensor 602 becomes equal to the target temperature. Note that the temperature control section 806 may control the wavenumber of the alternating-current voltage supplied to the heater 601 using a zero-crossing of the alternating-current voltage flowing through the first line, which has been detected by the supply state monitoring section 801, as a reference. That is to say, as the zero-crossing detection circuit 505 for wavenumber control can be diverted to or used also in the welding test, it would be possible to reduce the number of components.

A switching section 807 may function as a switch for switching a target of the first welding detection and a target of the second welding detection from the first relay 501 to the second relay 502 if both of the first welding detection and the second welding detection have discovered that the first relay 501 is not welded. This would make it possible to perform welding detection alternately with respect to the first relay 501 and the second relay 502. Furthermore, as only one of the relays serves as a detection target in one welding detection, it should be possible to reduce a period for one welding detection.

Note that the CPU 171 may be configured to perform welding detection at a timing of the end of image formation, and not to perform welding detection at all at a timing of the start of image formation. However, in this case, in the image forming apparatus that sleeps as soon as image formation ends, the CPU 171 cannot output the result of welding detection to the operation unit 172. Furthermore, upon transition to sleep, the result of welding detection is deleted from the RAM 175 in some cases. There may be cases where the 24 VIL power source is turned OFF and the CPU 171 cannot perform welding detection upon transition to sleep in the first place. In these cases, the CPU 171 would not be able to output the result of welding detection to the operation unit 172 upon return from sleep. In the present embodiment, the first welding detection is performed in accordance with the result of performance of the second welding detection, which would be advantageous.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus, comprising:

a first line that is one of a neutral line and a hot line that supply, to a load, power supplied from an alternating-current power source;

a second line that is another one of the neutral line and the hot line;

a first relay, arranged on the first line, that turns ON/OFF a supplying of the power to the load;

a second relay, arranged on the second line, that turns ON/OFF a supplying of the power to the load;

a monitor configured to monitor a power supply state at a position in a stage subsequent to the first relay on the first line;

a controller configured to control ON/OFF of each of the first relay and the second relay;

a welding detector configured to perform first welding detection that detects whether the first relay is welded in accordance with a power supply state monitored by the monitor when a first performing condition is satisfied, and performing second welding detection that detects whether the first relay is welded in accordance with a power supply state monitored by the monitor when a second performing condition is satisfied; and a storage configured to store a result of the second welding detection, wherein the first performing condition is that the result of the second welding detection stored in the storage indicates that the first relay is welded, the welding detector performs the first welding detection when the result of the second welding detection indicates that the first relay is welded, and skips the first welding detection when the result of the second welding detection does not indicate that the first relay is welded;

the controller performs control to turn ON the second relay and turn OFF the first relay while the welding detector is performing the first welding detection or the second welding detection, and the controller further performs control to turn ON each of the first relay and the second relay when an image forming job is to be started.

2. The image forming apparatus according to claim 1, wherein the first performing condition is that the image forming apparatus has been instructed to perform an image forming job and the result of the second welding detection indicates that the first relay is welded, and the second performing condition is that the image forming apparatus has ended the image forming job.

3. The image forming apparatus according to claim 1, wherein the first performing condition is that the image forming apparatus is activated and the result of the second welding detection indicates that the first relay is welded, and the second performing condition is that the image forming apparatus has been instructed to stop.

4. The image forming apparatus according to claim 1, wherein the first performing condition is that the image forming apparatus has returned from a power saving mode and the result of the second welding detection indicates that the first relay is welded, and the second performing condition is that the image forming apparatus satisfies a condition for making a transition to a power saving mode.

5. The image forming apparatus according to claim 1, wherein the monitor detects a zero-crossing of an alternating-current voltage that is applied to the load via the first line as the power supply state.

6. The image forming apparatus according to claim 1, wherein the welding detector performs the first welding detection when the result of the second welding detection stored in the storage indicates that the first relay is welded, and skips the first welding detection when the result of the second welding detection stored in the storage does not indicate that the first relay is welded.

7. The image forming apparatus according to claim 6, wherein when the first welding detection has discovered that the first relay is not welded, the controller switches the first relay from OFF to ON to perform the image forming job.

8. The image forming apparatus according to claim 6, further comprising a notifying unit configured to notify information;

wherein when the first welding detection has discovered that the first relay is welded, the controller controls the notifying unit so that the notifying unit notifies a message that gives notification of welding of the first relay.

9. The image forming apparatus according to claim 6, further comprising:

a maintenance door that is opened during maintenance of the image forming apparatus;

a door switch that connects a relay power source to each of the first relay and the second relay when the maintenance door is closed, and connects the relay power source to neither the first relay nor the second relay when the maintenance door is opened; and a second storage configured to store information indicating whether the second welding detection has been performed, wherein the welding detector does not perform the second welding detection and causes the second storage to store information indicating that the second welding detection has not been performed in a case where the relay power source is connected to neither the first relay nor the second relay when the second welding detection is to be started, and performs the second welding detection in a case where the relay power source is connected to each of the first relay and the second relay when the second welding detection is to be started, and the welding detector further performs or refrains from performing the first welding detection depending on the result of the second welding detection stored in the storage in a case where the second storage does not store information indicating that the second welding detection has not been performed, and performs the first welding detection, irrespective of the result of the second welding detection stored in the storage, in a case where the second storage stores information indicating that the second welding detection has not been performed.

10. The image forming apparatus according to claim 6, wherein the monitor detects a zero-crossing of an alternating-current voltage that is applied to the load via the first line as the power supply state, and the welding detector determines that the first relay is welded when the monitor has detected the zero-crossing, and determines that the first relay is not welded when the monitor has not detected the zero-crossing.

11. The image forming apparatus according to claim 6, further comprising:

a power switch configured to turn ON/OFF the second line to control power supplied to a heater of a fixing device, the heater being the load;

a temperature detector configured to detect a temperature of the heater; and wherein the controller controls the power switch so that a temperature detected by the temperature detector becomes equal to a target temperature, wherein the controller controls a wavenumber of an alternating-current voltage supplied to the heater using a zero-crossing of an alternating-current voltage flowing through the first line as a reference, the zero-crossing having been detected by the monitor.

12. The image forming apparatus according to claim 6, wherein the controller changes a target of the first welding detection and a target of the second welding detection from the first relay to the second relay in a case where both of the first welding detection and the second welding detection have discovered that the first relay is not welded.

* * * * *